United States Patent [19]

Jarvis

[11] Patent Number: 4,787,331

[45] Date of Patent: Nov. 29, 1988

[54] SHIELD FOR PROTECTING AUTOMOBILE WHEELS

[75] Inventor: Randall R. Jarvis, Madison Heights, Mich.

[73] Assignee: William Ellis, Warren, Mich. ; a part interest

[21] Appl. No.: 153,191

[22] Filed: Feb. 8, 1988

[51] Int. Cl.[4] ..... B05C 21/00

[52] U.S. Cl. ..... 118/504; 118/505

[58] Field of Search ..... 118/504, 505; 51/274

[56] References Cited

U.S. PATENT DOCUMENTS

| | | | |
|---|---|---|---|
| 2,119,072 | 5/1938 | Cohen | 280/150 |
| 2,210,233 | 8/1940 | De Lillo | 91/65 |
| 2,212,166 | 8/1940 | Nelson | 91/65 |
| 2,231,333 | 2/1941 | Gunn | 91/65 |
| 2,634,704 | 4/1953 | Morrison | 118/505 |
| 2,726,634 | 12/1955 | Horner | 118/505 |
| 2,835,222 | 5/1958 | Hall | 118/505 |

*Primary Examiner*—John McIntosh

*Attorney, Agent, or Firm*—Basile and Hanlon

[57] ABSTRACT

A protective shield for use during spray painting of automobile panels. The shield covers an automobile wheel and tire during the spray painting of panels adjacent the wheel. The shield comprises a circular disk larger than the tire, a segment removed from the disk along the bottom and a flange extending axially inward along the perimeter of the disk ending at the segment. The segment and the flange combine to make the shield free standing. A hand hold is provided comprising a U-shaped cut formed in the center of the disk producing a hinged flap for grasping the shield for moving it about.

5 Claims, 1 Drawing Sheet

SHIELD FOR PROTECTING AUTOMOBILE WHEELS

BACKGROUND OF THE INVENTION

I. Field of the Invention

The present invention generally relates to shields and, in particular, the present invention is concerned with a shield for protecting automobile wheels during the process of painting the automobile's adjacent panels.

II. Description of the Prior Art

Devices for masking off portions of an article during the process of spray painting are known in the art. Inventions for protecting automobile wheels and tires during the process of spray painting the automobile fenders are disclosed in U.S. Pat. Nos 2,119,072; 2,210,233; 2,212,166; 2,231,333; 2,634,704; 2,726,634; and 2,835,222. These patents are relevant to the applicant's invention in that they represent the closest prior art for protecting the automobile portions from overspray during the process of spraying panels of the automobile. The shields employed in the prior art are made from cloth which, when flexed in the process of mounting said shields on the wheel of the automobile, can break loose any paint that is adhered to the shield. Any particle that breaks loose can be deposited on the newly sprayed paint surface. Any foreign particle, such as a fleck of paint deposited on a newly painted surface, essentially ruins the surface and requires sanding and repainting of the surface to correct the defect. U.S. Pat. No. 2,231,333, for example, discloses the use of a corrugated creped or wrinkled material being stretched horizontally over the wheels. This process will loosen particles of dried paint which had accumulated during prior use of the shield. The possibility of dislodging a paint particle during a subsequent spraying process and depositing such particle upon the sprayed surface is greatly increased. Other prior art devices make the use of a cloth material for draping over the wheel as a shield. This type of shield also has the tendency to collect paint overspray in gobs which can easily be dislodged during the flexing operation required to drape the shield over the wheel. Frequent replacement of cloth or corrugated shields is the only answer to the problem of dried paint flaking off the shield. However, this adds to the overall cost of the shield's use by reducing its useful life.

The aforementioned prior art in the opinion of the applicant and applicant's attorney represents the closest prior art and/or information of which the applicant and his attorney are aware.

SUMMARY OF THE INVENTION

The present invention, which will be described in greater detail hereinafter, comprises a protective shield for protecting automobile wheels from overspray during the process of painting the automobile. The protective shield is a circular disk to cover an automobile wheel and tire during the process of painting automobile panels. The circular disk is configured to be larger than the tire it is intended to protect and has a segment removed from the disk along the bottom thereof. A flange extends axially inward along the perimeter of the disk ending at the segment. The segment and the flange combine to provide a means for permitting the shield to be free standing when resting on the ends of the flange. The shield is preferably made from a plastic material which is either injection molded or vacuum formed.

The plastic is capable of permitting paint to adhere strongly to its surface and resist the peeling and flaking of the paint during subsequent spray painting operations. A plastic material could also be used that does not allow paint to strongly adhere to its surface and allows the overspray to be readily peeled off in one piece. A hand hold is provided which enables the user's fingers to grasp the shield and move it about easily. The hand hold or handle includes a hinged flap which is displaced by the user's fingers to grasp the shield while moving the shield from one place to another, and the flap returns to a closed position to protect the wheel against overspray once the user's fingers have been removed.

It is therefore a primary object of the present invention to provide a new and improved shield for protecting automobile wheels during the process of spray painting automobile panels.

It is a further object of the present invention to provide a shield that is economical to produce and is capable of being used many times without deterioration of its useful function.

It is yet another object of the present invention to provide the shield with a hand hold that is useful for readily moving the shield from place to place.

It is yet another object of the present invention to provide a hand hold that is self-sealing when not in use.

Further objects, advantages and applications of the present invention will become apparent to those skilled in the art of spray paint shielding when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numbers refer to like parts throughout the various views, and wherein.

DESCRIPTION OF THE PREFERRED EMBODIMENTS

Figure 1:
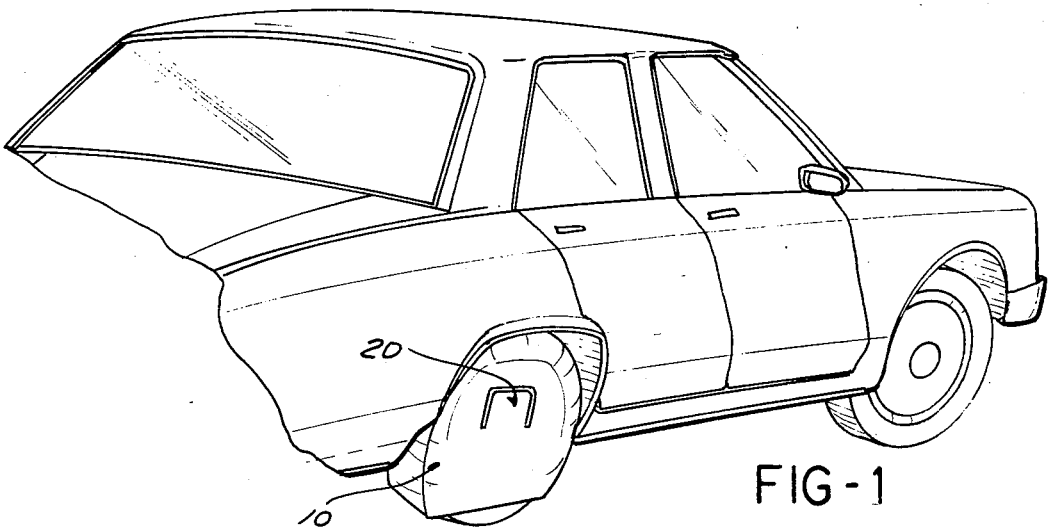
FIG. 1 illustrates a broken perspective view of an automobile utilizing the shield of the present invention.
Figure 2:
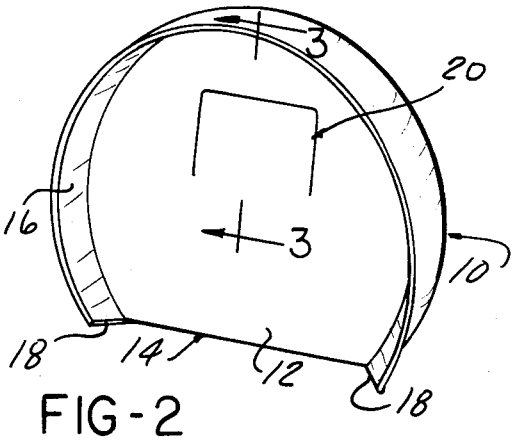
FIG. 2 is a rear perspective view of the shield of the present invention.

Referring now to the drawing, there is illustrated in FIG. 1 an example of the present invention in the form of a shield 10 for protecting automobile wheels during the spray painting of nearby automobile panels. As shown in FIG. 2 of the drawing, the protective shield of the present invention comprises a circular disk 12 with a segment 14 removed from the bottom of the disk 12. A flange 16 extends axially inward along the perimeter of the disk 12 and ends at the segment 14. A flat spot formed along the bottom of the disk 12 by the removal of the segment 14 and the ends of the flange 16 provides a means for making the shield free standing when resting on the ends of the flange 16. The ability of the shield to be free standing is important in that this enables the shield to adequately cover a large number of wheels that may be substantially smaller than the shield itself, yet provide adequate coverage and protection of the wheel against overspray during use.

Figure 3:
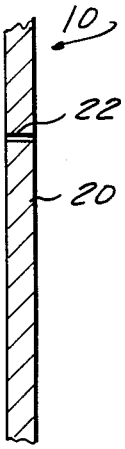
FIG. 3 illustrates a broken, cross-sectional view of the hand hold flap of the present invention taken along line 3—3 of FIG. 2.
Figure 4:
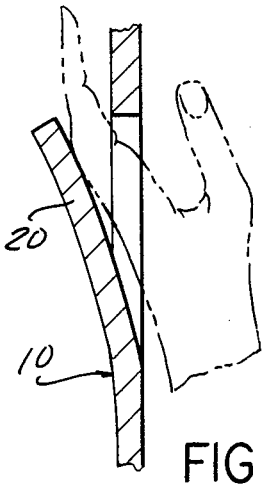
FIG. 4 illustrates the flap of FIG. 3 with the user's hand employed to grasp the shield.

As shown in FIG. 3, the shield 10 further comprises a hand hold 20 for grasping the shield and moving it about. The hand hold 20 comprises a U-shaped cut formed in the center of the disk 10 forming a hinged flap. The flap may be displaced by the user's fingers to grasp the shield as shown in FIG. 4 of the drawing. The U-shaped cut 20 is formed by a narrow slit 22 cut through the disk 12 as shown in FIG. 3 of the drawing. The narrow slit 22 can be readily formed and very inexpensively produced in a plastic shield, but the hand hold becomes very functional and inexpensive in that once the user's hand, as shown in FIG. 4 of the drawing, is removed, the flap 20 returns to the condition shown in FIG. 3 and the shield is sealed against any overspray passing the shield 10.

Figure 5:
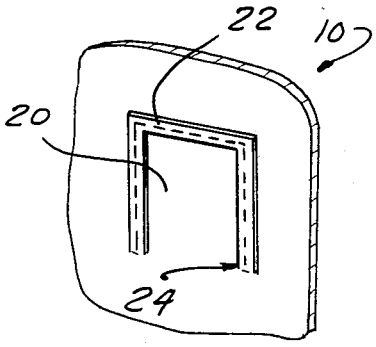
FIG. 5 illustrates the flap of FIG. 4 in a perspective view with a flange employed to aid in sealing the flap against paint overspray.

FIG. 5 of the drawing illustrates an alternate embodiment of the shield 10 wherein a flange 24 is attached to the perimeter of the hand hold 20. The flange 24 further aids in sealing the slit 22 against overspray leaking past the shield 10.

In a preferred embodiment, the shield 10 is made from a semi-rigid plastic material that allows paint overspray to adhere to the shield and prevents the paint from breaking loose and marring the surface that is being painted. This permits the use and reuse of the shield 10 many times, which makes the use of the overall shield quite economical. The cloth and corrugated articles used as shields in the present art are unsatisfactory in that, after a few uses, the paint attached to the shield breaks off and is readily dislodged and can attach itself to the surface being sprayed, rendering the surface unsightly and requiring a sanding and a respraying of the surface to make it acceptable. A shield made from a plastic material that allows the paint overspray to be easily peeled off and the shield cleaned would also be acceptable.

Figure 6:
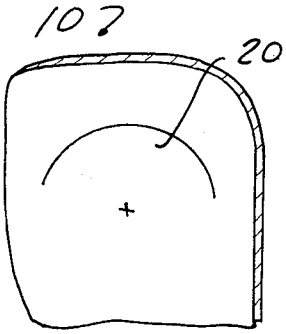
FIG. 6 illustrates the flap of FIG. 3 formed from a radius having a common center with the tire.

FIG. 6 illustrates a flap 20 formed from a radius having a common center with the arc defining the perimeter of the shield. The mold projection to make the flap 20 can easily be turned at the time the mold is turned, saving extra operations in the making of the mold.

It can thus be seen that the present invention has provided a new and improved system for shielding automobile wheels while the panels adjacent the wheels are being spray painted. The shield of the present invention can be produced economically and be used many times when made from an injection molded or vacuum molded plastic material.

It should be understood by those skilled in the art of shielding or masking systems that other forms of the applicant's invention may be had, all coming within the spirit of the invention and the scope of the appended claims.

Having thus described my invention, what I claim is:

1. A protective shield to cover an automobile wheel and tire for use during spray painting of automobile panels, the improvement comprising:

a circular disk larger than said tire;

a segment removed from said disk along the bottom thereof;

a flange extending axially inward along the perimeter of said disk ending at said segment; and whereby said shield is free standing when resting on the ends of said flange.

2. The shield as defined in claim 1 further comprising a hand hold comprising an inverted, U-shaped cut formed in the center of said disk forming a hinged flap; wherein said flap may be displaced by the user's fingers to grasp the shield, and when the user's fingers are removed, said flap returns to a closed position.

3. The shield as defined in claim 2 further comprising a flange secured to the perimeter of said flap to aid in sealing said hand hold in the closed position.

4. The device as defined in claim 3 wherein said shield is made from injection molded plastic.

5. The device as defined in claim 3 wherein said shield is made from vacuum formed plastic

* * * * *